US005582099A

United States Patent [19]

Rosser

[11] Patent Number: 5,582,099

[45] Date of Patent: Dec. 10, 1996

[54] TRUSS BEND CORRECTION SYSTEM

[75] Inventor: Michael C. Rosser, Roanoke, Tex.

[73] Assignee: Alpine Engineered Products, Inc., Pompano Beach, Fla.

[21] Appl. No.: 451,961

[22] Filed: May 26, 1995

[51] Int. Cl.[6] ..... B30B 3/04; B27H 1/00

[52] U.S. Cl. ..... 100/35; 100/155 R; 100/173; 100/176; 100/913; 144/255

[58] Field of Search ..... 100/35, 155 R, 100/161, 167, 173, 176, 913; 144/242 C, 249 R, 255, 330, 332, 344, 352, 353, 381

[56] References Cited

U.S. PATENT DOCUMENTS

| | | | |
|---|---|---|---|
| 336,899 | 3/1886 | Davis | 144/255 |
| 429,640 | 6/1890 | Rembert | 100/161 |
| 852,826 | 5/1907 | Doherty et al. | 144/255 |
| 1,482,136 | 1/1924 | Magono | 144/255 |
| 3,464,348 | 9/1969 | McGlinchey | 100/210 |
| 3,538,843 | 11/1970 | Lubin | 100/53 |
| 3,855,917 | 12/1974 | Farrell et al. | 100/35 |
| 4,005,520 | 2/1977 | Sanford | 100/913 |
| 4,154,164 | 5/1979 | Hammond | 100/913 |
| 4,287,822 | 9/1981 | Bowser | 100/35 |
| 5,111,861 | 5/1992 | Gore et al. | 100/913 |
| 5,211,108 | 5/1993 | Gore et al. | 100/48 |

FOREIGN PATENT DOCUMENTS

| | | | |
|---|---|---|---|
| 481003 | 4/1954 | Italy | 144/255 |
| 496 | 2/1869 | United Kingdom | 100/161 |

OTHER PUBLICATIONS

20" Roller Press product brochure, Alpine Engineered Products, Inc. (undated).

*Primary Examiner*—Stephen F. Gerrity
*Attorney, Agent, or Firm*—Crutsinger & Booth

[57] ABSTRACT

A truss bend correction system having a pair of in-feed correction rollers, a pair of finish rollers, and an out-feed correction roller define a path for counterbending the joints of a truss to reform the nail plates and thereby flatten the overall truss. The in-feed correction rollers and the out-feed correction roller are oriented downwardly with respect to the finish rollers so that an undesired upward bow of a truss joint is counterbent downwardly, thereby straightening the joints of the truss.

25 Claims, 7 Drawing Sheets

TRUSS BEND CORRECTION SYSTEM

TECHNICAL FIELD OF THE INVENTION

The present invention relates in general to equipment for constructing and fabricating structural trusses, and more particularly for correcting an inherent bend or camber that often exists in trusses formed with cord member and web member joints fastened together by nail plates, or the like.

BACKGROUND OF THE INVENTION

The roofs, floors and other parts of many buildings and structures are constructed with prefabricated trusses made of wood or similar materials. Such type of trusses are typically constructed using cord members that define the basic outline and shape of the truss, and using internal interconnecting web members to provide structural integrity and strength to the overall truss. In this manner, the trusses need not be made of a solid material, but can nevertheless withstand significant loads spanning between end points such as walls or foundations. Although, trusses can be constructed of metal framework members, the cost and weight can be significant. A wide variety of wood trusses are nevertheless available, due primarily to the lower cost than that of metal trusses. The cost of wooden trusses is lower due primarily to the lower cost of lumber, and such trusses are less labor intensive to fabricate. Much of the construction and fabrication of wooden trusses has been automated to reduce the manual labor involved, especially the assembling and fastening together of the truss members at the joints to form a rigid and integral unit. Currently, the structural cord and web members of a truss are fastened together by nail plates placed on opposite sides of the joint, and pressed together so as to be embedded in the wood to permanently fix the truss members together at the joint.

FIG. 1 illustrates a table or jig 10 typically used for fabricating a truss 12. The truss 12 includes cord members 14, 16 and 18, with the internal web members 20–28 to provide structural integrity to the truss. The table 10 is supported above a floor by legs, standoffs, or the like. While not shown, the top of the table 10 has a number of slots or holes for the insertion of pegs to define the size and outline of the truss. The jig is arranged so that the parts of the truss can be laid out in a prearranged manner on the table 10, with nail plates, such as 30, disposed above and below each truss joint. As can be appreciated, each different truss 12 requires a different jig or pattern to arrange the wooden parts of the truss thereon. Once the truss parts are arranged on the table 10 with the nail plates 30 on each side of the respective joints, a gantry roller 32 is moved along the table 10 by way of a rail arrangement 34, thereby squeezing the truss 12 between the table and the roller 32. The gantry rollers and truss tables are shown in more detail in U.S. Pat. Nos. 3,464,348; 3,538,843; 3,855,917 and 5,211,108, the disclosures of which are incorporated herein by reference.

FIG. 2 illustrates in more detail a joint 36 of a truss 12 having cord members 14 and 16 butted together at the ends thereof. A top nail plate 38 and a bottom nail plate 40 are placed on each side of the truss joint 36. The gantry roller 32 is then rolled to the right over the truss, as shown in FIG. 2, to thereby partially embed the sharp projections 42 of the nail plates into the truss members 14 and 16. The purpose of the gantry roller 32 is to only partially embed the nail plates into the wood to make a more rigid and unitary structure for further processing.

Once the gantry roller 32 has passed over the truss 12 and has partially embedded the nail plates 38 into the wood members, the truss is processed by a pair of downstream finish rollers which completely embed the nail plates into the wooden truss members. As a result of the foregoing truss fabricating steps, an undesired bow, bend or camber results, as shown in FIG. 3. The bow is inadvertently formed in the truss joints because the gantry roller 32 does not apply a uniform pressure to all parts of the top nail plate 38, whereas the table 10 does apply a uniform pressure to the entire surface area of the bottom nail plate 40. The undesirable bow formed at a truss joint is generally in a direction shown in FIG. 3, where the truss members that extend away from the joint are bowed upwardly. It can be appreciated that a slight bow is generally formed at each truss joint 36, and the extent of the overall bow of the entire truss becomes cumulative with the number of joints involved. In other words, as the truss becomes longer, and thus involves more joints and larger nail plates, the overall bow of the truss tends to become excessive.

As noted above, after the truss 12 has been fastened together by the incomplete embedding of the nail plates into the truss joints, the entire truss itself is moved to a powered roller conveyor where the truss is carried to a pair of finish rollers, which are not shown in FIGS. 1–3. The finish rollers are essentially a pair of vertically spaced-apart rollers that receive the leading end of the truss to pull it between the rollers and completely embed the nail plates into the wood truss members. To that end, the spacing between the finish rollers is somewhat less than the thickness of the wood truss members, thereby assuring that the nail plates will be completely pressed into the wood truss members. Experience has shown that the finish rollers do not remove the bow at the truss joints, and thus the completed truss still includes an inherent bow at the joints thereof. The bow at each truss joint is not only unsightly, but it can be both structurally unsound and troublesome in fastening other structural components thereto, such as wood cross pieces to tie a number of truss members together.

It can be seen from the foregoing that an inherent problem exists in the formation of wooden trusses with the members attached together by nail plates, and where a gantry roller, or the like, is utilized to partially embed the nail plates to the truss members. A need therefore exists for a technique for removing the bow at each truss joint to thereby straighten the truss. A further need exists for a technique to straighten trusses of the type described without significantly altering the established prefabrications techniques or equipment. A further need exists for truss straightening equipment that is cost effective, easily installed in existing assembly lines, and is reliable and trouble free.

SUMMARY OF THE INVENTION

In accordance with the principles and concepts of the invention, methods and apparatus are disclosed for correcting or removing the bow in wooded trusses formed during fabrication thereof. According to the invention, the preassembled truss is passed through a truss bend correction system which deforms the truss in a direction opposite to the bend previously formed in the metal nail plates at the joints thereof. In other words, if the truss joints are bowed upwardly, the truss is processed through the truss bend correction system which counterbows the joints in an opposite, or downwardly direction, thereby removing the bows and straightening the overall truss structure.

In the preferred embodiment of the invention, the truss bend correction system is incorporated with the operation of the finish rollers. Again, the finish rollers are vertically spaced apart somewhat less than the width of the truss boards themselves so that the nail plates are pressed completely into the wood. A truss correction roller is fixed on the in-feed side of the finish rollers as well as the out-feed side to provide the counter bending function as the truss passes therethrough. The bottom surfaces of the in-feed and out-feed counterbending correction rollers are located vertically lower than the bottom surface of the top finish roller. In this manner, as the truss if pulled through the finish rollers, the in-feed and out-feed correction rollers force the truss members downwardly, with respect to the central finish rollers, thereby correcting the undesired bow at each joint of the truss. The extent of the bow correction can be varied depending on the distance the bottom surfaces of the rollers are offset.

In a preferred embodiment of the invention, the in-feed correction roller assembly constitutes a pair of vertically spaced-apart rollers, one of which is driven and the other of which is spring-loaded so as to sufficiently engage the truss and pull it forwardly without embedding the nail plates further into the truss members. Also, the in-feed correction rollers can be vertically adjusted to achieve the desired degree of counterbending of the truss joint. The out-feed correction roller is vertically adjustable to achieve the desired degree of counter-bow correction. The in-feed correction roller assembly, as well as the finish roller assembly, and the out-feed roller assembly constitute different frame units, each spatially fixed with respect to each other to provide the appropriate degree of counterbending of the truss that passes therethrough.

In another embodiment of the invention, the finish roller assembly includes as an integral unit therewith, an in-feed correction roller and an out-feed correction roller. This second embodiment is well adapted for new installations where the complete embedding of the nail plates in the truss and the counterbending function can be achieved by a single multi-roller unit.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, elements or functions throughout the views, and in which.

DETAILED DESCRIPTION OF THE INVENTION

Figure 4:
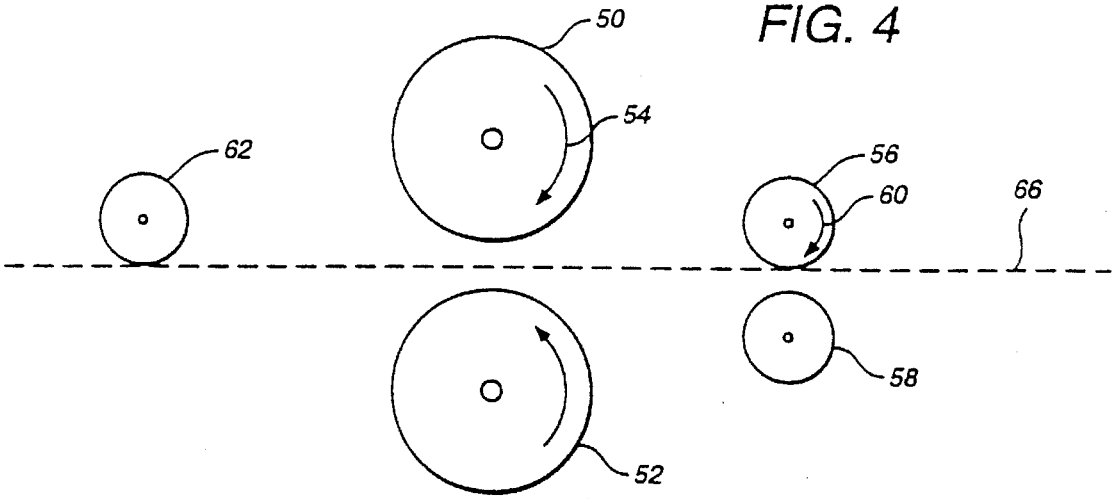
FIG. 4 illustrates the arrangement of the in-feed correction rollers and the out-feed correction roller with respect to the finish rollers which is effective to counterbend the truss and remove the undesired bow.

With reference now to FIG. 4, there is depicted an exemplary arrangement of the in-feed and out-feed correction rollers with respect to the finish rollers to achieve a counterbending of wooden trusses to remove the inherent bow formed therein when the top and bottom nail plates are nonuniformly pressed into the wood members. Although the preferred embodiment of the invention contemplates the use of finish rollers disposed between the in-feed and out-feed correction rollers, those skilled in the art may prefer to utilize other arrangements. For example, various truss fabricating systems may provide upstream finish rollers for completely embedding the nail plates into the truss joints, and thereafter utilize the truss correction rollers without the use of finish rollers. In such a system, the intermediate rollers or other equipment may be utilized simply as providing a truss deformation member in the path of the travel of the truss to provide the counterbending function.

With regard to FIG. 4, there is shown an upper finish roller 50 spaced apart from a lower finish roller 52. Finish rollers are conventionally available for the purposes described herein. The upper finish roller 50 is driven in the direction shown by arrow 54. An in-feed pair of rollers 56 and 58 is disposed upstream from the finish rollers 50 and 52. The upper in-feed correction roller 56 is optionally driven in the direction shown by arrow 60. An out-feed correction roller 62 is also disposed downstream from the finish rollers in the travel path of the truss. Although not critical to the operation of the invention, the horizontal spacing between the in-feed correction rollers 56 and 58 with respect to the finish rollers 50 and 52 is about 18–24 inches. The same horizontal distance exists between the finish rollers 50 and 52 and the out-feed correction roller 62. The vertical spacing between the finish rollers 50 and 52 is somewhat less than the width of the truss member passing therebetween. For example, if the width of the wooden truss member is 1.5 inches, then the spacing between the bottom surface of the upper finish roller 50 and the top surface of the bottom finish roller 52 is set to be somewhat less than 1.5 inches. In this manner, it is assured that the truss member is firmly pinched between the finish rollers 50 and 52 so that the nail plates 38 and 40 are completely pressed into the top and bottom surfaces of the wooden truss members. A secure and rigid truss joint is thereby formed.

As will be described in more detail below, the top in-feed correction roller 56 is adjustably fixed, but the bottom in-feed correction roller 58 is spring loaded and thereby provides a light compression force to the truss that passes therebetween. The out-feed correction roller 62 is also adjustably fixed with respect to the finish rollers 50 and 52, as well as the in-feed rollers. While it may not be absolutely necessary that the invention employ rollers to guide the truss through the counterbending apparatus, the utilization of rollers reduces the force required to move the truss forwardly, as well as assists in moving the truss to complete the operation of embedding the nail plates completely into the truss members.

With reference again to FIG. 4, the broken line 66 shows a reference that is tangent to the bottom surface of the top in-feed correction roller 56 and the bottom surface of the out-feed correction roller 62. A truss passing through the truss bend correction system would preferably engage the bottom surfaces of the correction rollers 56 and 62. It is noted that the tangent line 66 does not pass through or become tangent to any surface of either of the finish rollers 50 and 52. Rather, the finish rollers 50 and 52 are offset from the tangent line 66, thereby forcing the truss to be diverted from a straight path. Indeed, the finish rollers 50 and 52 are offset in an upward direction to form a circuitous travel path to counterbend the joints of a truss. Stated another way, if a truss fed to the correction system is bowed upwardly, then the offset arrangement of the finish rollers with respect to the correction rollers is such that the truss is counterbowed downwardly. On the other hand, if the truss fed to the correction system has joints bowed downwardly, then the arrangement of the rollers is such that the joints are counterbowed upwardly as the truss passes therethrough. Indeed, even if the lower surface of the upper finish roller 50 is tangent to the line 66 to form a straight travel path, a certain degree of counterbending will still exist. As will be described more thoroughly below, the degree of counterbending is generally determined by experimental testing to verify the extent of counterbending necessary to straighten each joint of a truss. In brief summary, upward positioning of the finish rollers 50 and 52 with respect to the correction rollers increases the extent by which upwardly bowed trusses can be corrected. On the other hand, moving the finish rollers 50 and 52 downwardly with respect to the in-feed and out-feed correction rollers provides correction for downwardly bowed truss members. It should be appreciated that while the finish rollers are noted to be moved with respect to the correction rollers, the converse can also be carried out. In other words, the finish rollers can be held fixed and the correction rollers moved in unison up or down to provide the desired counterbending of trusses passed through the correction system.

From the foregoing, those skilled in the art may further automate the adjustability of the correction rollers with respect to the finish rollers. Sensing equipment may be utilized to dynamically measure the extent of the bow at each truss joint. Based on the extent of the bow at each truss joint, both the in-feed and out-feed correction roller assemblies can be dynamically adjusted up or down to provide the correct degree of counterbending.

Figure 1:
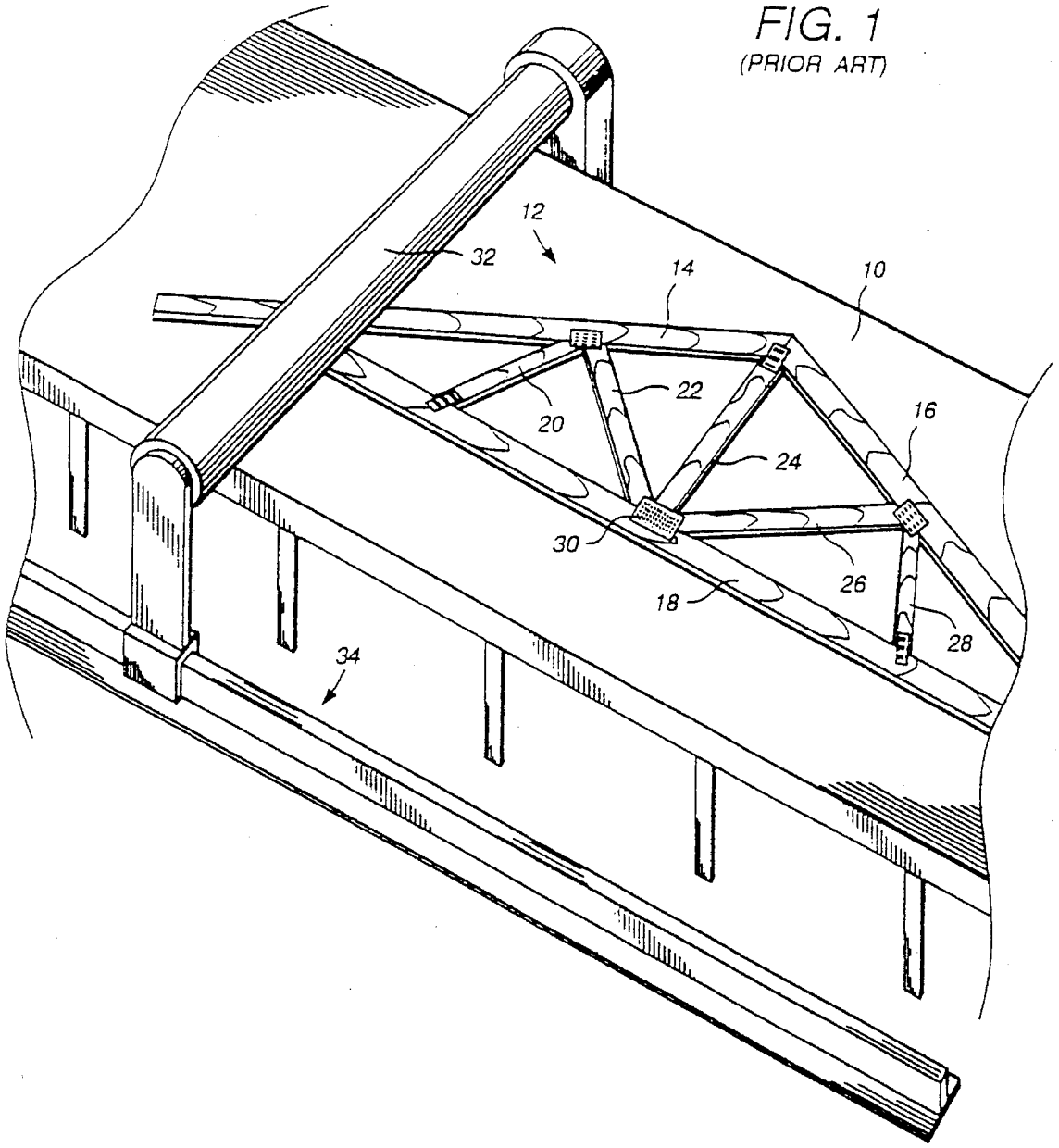
FIG. 1 (PRIOR ART)
FIG. 1 is an isometric view of a truss assembly bed and a gantry roller for fabricating wooden trusses.
Figure 2:
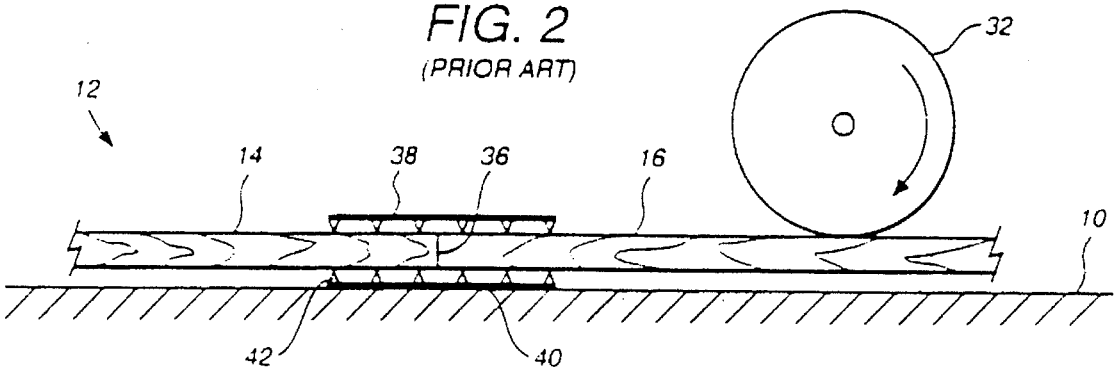
FIG. 2 (PRIOR ART)
FIG. 2 is a side view of the gantry roller operation in which the nail plates are partially embedded in the wood members of the truss.
Figure 3:
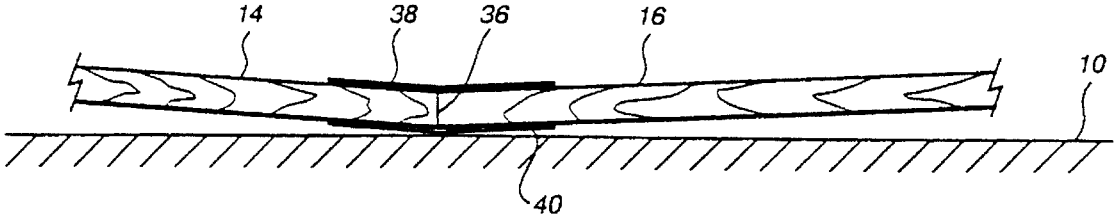
FIG. 3 (PRIOR ART)
FIG. 3 is a side view of a truss joint in which the nail plates have been fully embedded to secure the truss joint, and in which an inherent bend is formed therein due to the gantry roller operation.
Figure 5:
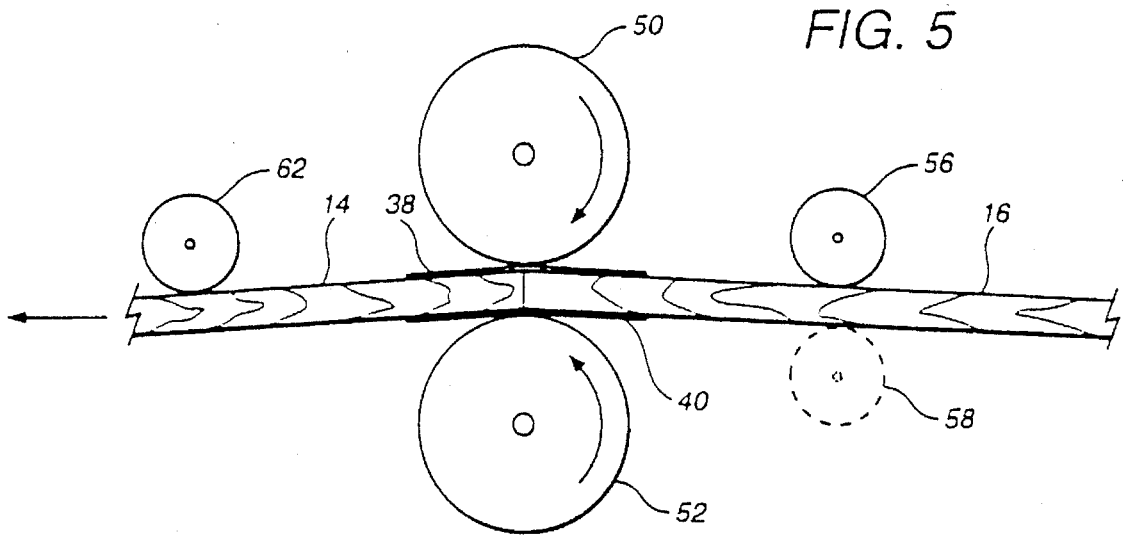
FIG. 5 is similar to FIG. 4, but shows a truss joint being processed through the truss bend correction system.

FIG. 5 illustrates in simplified form the truss bend correction system with the rollers arranged to counterbend upwardly bowed truss joints. When an upwardly bowed truss, such as shown in FIG. 3, is passed through the truss bend correction system, each side of the truss joint is forced into a downwardly bowed arrangement, as shown in FIG. 5. As noted above, the extent of counterbend correction can be determined by trial and error techniques. However, in practice, it has been generally found that for every angular degree that the truss joint is bowed from a flat position, the finish rollers and correction rollers are arranged to provide fewer degrees of angular counterbow. For example, it is believed that a 5°–15° bow is offset by about a 3° counterbow, thereby resulting in a flat truss joint. It can be appreciated that the nail plates 38 and 40 are generally constructed of metal, and therefore are somewhat malleable, and thus can be reformed by pressure from the finish rollers 50 and 52 while the truss joint is counterbowed. Indeed, while only the top nail plate 38 was initially deformed by the gantry roller 32, both the top 38 and bottom 40 nail plates are counterbent by the truss bend correction system.

Although in the preferred embodiment the finish rollers 50 and 52 completely set or embed the nail plates into the truss joint, it is believed that the counterbending function can nevertheless be realized even if the nail plates have been firmly and completely embedded into the truss joint, prior to the truss being passed through the truss bend correction system. The use of rollers is especially advantageous, as the truss joints are automatically corrected as to bow when passed through the correction system. Although every portion of the truss undergoes a counterbow when passed through the correction system, those flexible wooden portions of the truss that do not have joints simply result in a temporarily counterbowed condition, whereupon the wood members return to their original flat position when exiting the system. It should be noted that it is important to initially preselect wood or lumber that is not initially bowed, as the truss bend correction system cannot straightened out bowed lumber itself, but only malleable or resetable truss member fabricating apparatus and materials.

While the preferred embodiment described herein employs a number of rollers to carry out a dynamic counterbending function as the truss continuously moves through the correction system, other techniques well within the principles and concepts of the invention can be employed. For example, the truss can be transported to and stopped at a static correction bending system, where hydraulic or pneumatic cylinders can be operated to apply the necessary up and down pressures to a truss joint to thereby counterbend the nail plates appropriately. While such type of static system may be suitable for the intended function of counterbending truss joints, such a technique requires more complicated equipment, and is more time consuming as the truss must undergo numerous movements and stops to achieve the counterbending function.

Figure 6:
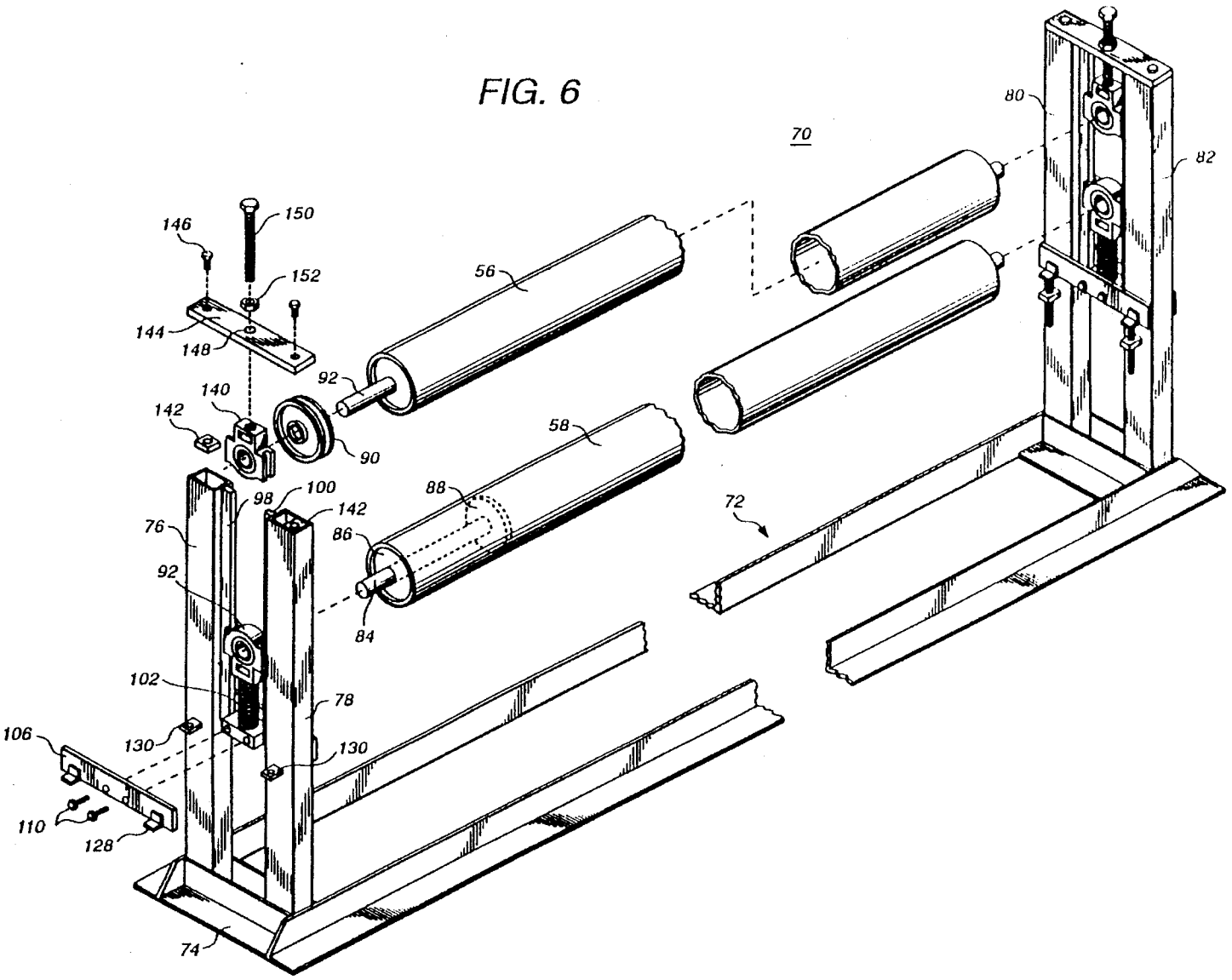
FIG. 6 is an isometric view of the in-feed correction roller assembly with the various parts thereof shown removed for purposes of clarity.

While the general principles and concepts of the invention have been described, reference is now made to FIG. 6 where there is illustrated the in-feed correction roller assembly 70 according to the preferred embodiment of the invention. The in-feed correction roller assembly 70 includes the upper elongate roller 56 and the lower elongate roller 58 described above. The length of the rollers depends on the base to peak size of the truss being straightened. In the preferred embodiment, the upper roller 56 is about 174 inches long, while the lower roller 58 is about 177 inches long. The rollers 56 and 58 are mounted for rotation in a frame 72 for fastening such assembly to a floor in the truss fabricating assembly line. The in-feed correction roller assembly 70 is preferably installed in an existing assembly line, just upstream from the finish roller assembly. The frame 72 includes a base 74 constructed of angle iron. Four rectangular tubular members 76–82 are fastened at the corners of the base 74 to provide uprights for spatially fixing the rollers 56 and 58 apart from each other, as well as fixing the pair of rollers at an approximate height above the floor to receive the partially completed trusses. Additionally, each in-feed correction roller 56 and 58 is mounted for accurate vertical adjustment. The manner of rotatably mounting each end of the pair of correction rollers 56 and 58 is substantially the same, and thus the apparatus associated with one end of each roller will be described.

Each in-feed correction roller, such as bottom roller 58, is constructed of a cylindrical, heavy gauge metal to prevent flexing when a truss is passed between the upper roller 56 and the lower roller 58. Each end of each roller includes a solid shaft, such as shown by reference numeral 84, that is welded to an end plate 86. The shaft 84 extends somewhat into the cylinder and is welded to a second circular plate spacer or baffle 88. The shaft 84 is first welded to the baffle 88, and then the baffle 88 is welded to the internal annular surface of the cylindrical roller. Lastly, the end plate 86 is slipped over the shaft 84 and welded to both the shaft and the inner annular surface of the cylindrical roller. Each end of both rollers 56 and 58 is constructed in a similar manner to provide an axle or shaft for rotatably mounting such rollers to the upright frame members. As noted above, the upper roller 56 is somewhat shorter than the lower roller 58 to thereby accommodate a pulley 90. While not shown, the shaft 92 of the upper in-feed correction roller 56 is slotted so that the pulley 90 can be keyed thereto.

Figure 7:
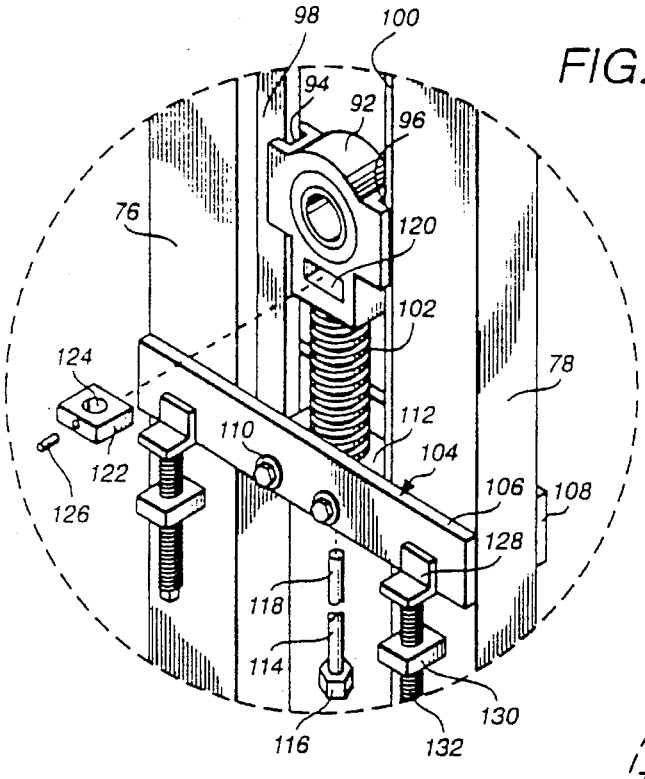
FIG. 7 is an enlarged view of the adjustable, spring loaded bearing mounts for the bottom in-feed correction roller.
Figure 8:
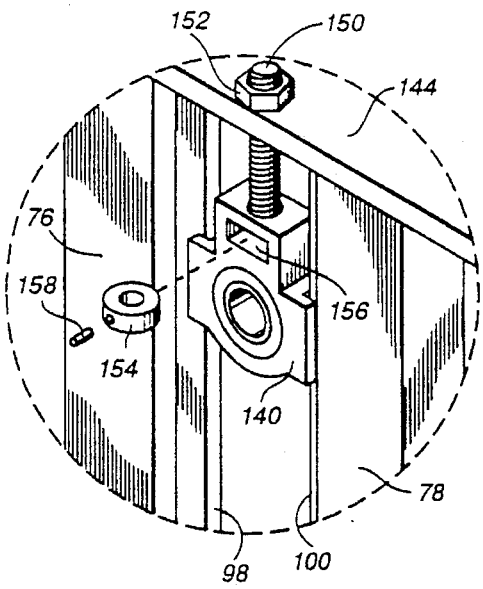
FIG. 8 is an enlarged view of the adjustable bearing mount for the top in-feed correction roller.

The apparatus for mounting the lower in-feed correction roller 58 to the pair of frame uprights 76 and 78 is shown in FIG. 6, as well as in enlarged drawing FIG. 7. The opposite end of the lower in-feed correction roller 58 is mounted in a similar manner. The shaft 84 of the bottom in-feed correction roller 58 is compression fit within the bore of a take-up bearing 92. The take-up bearing 92 is of conventional design, having a pair of channels 94 and 96 formed on opposite sides thereof, and slidable within corresponding rails 98 and 100 formed on the inside surfaces of the frame uprights 76 and 78. In this manner, the bearing 92 can be freely moved upwardly or downwardly to thereby adjust the vertical position of the roller 58.

A coil spring 102 is held between the bottom of the take-up bearing 92 and a bracket arrangement 104 that is mounted for vertical adjustment with respect to the frame uprights 76 and 78. A pair of opposing strap irons 106 and 108 are fastened by bolts 110 to a connecting base 112 on which the coil spring 102 rests. A rod 114 with a head 116 at one end and a transverse hole at the other end is passed through a hole (not shown) in the spring base 112 and extends through the spring and into a recessed area 120 of the take-up bearing 92. A square collar 122 is insertable into the recess 120. The collar 122 includes a bore 124 through which the rod 114 passes so that a split pin 126 can be driven through a small hole in both the collar 122 and the pin 114 to fix the end of the rod 114 with respect to the take-up bearing 92. In this manner, the take-up bearing 92 can move or float vertically by virtue of the compression of the spring 102, while the bracket arrangement 104 remains fixed to the frame uprights 76 and 78.

Each strap iron 106 and 108 has a pair of angle brackets 128 welded thereto. A pair of corresponding tabs 130 with threaded bores therethrough are welded to each of the frame uprights 76 and 78. When a threaded adjustment rod 132 is threadably engaged with the tabs 130, the end of the adjustment screws 132 abuts against the underside of the respective angle brackets 128. With this arrangement, the generally vertical position of the lower in-feed correction roller can be adjusted.

The floating bearing mounts for the lower in-feed correction roller 158 allows the truss 12 to be pulled through the in-feed correction roller assembly 70, while yet preventing a tight compression of the truss therebetween. As noted above, the gantry roller 32 employed in many truss fabricating assembly lines does not completely embed the nail plates into the wooden truss members. Therefore, when the incomplete truss is pulled through the in-feed correction roller assembly 70 by virtue of the top roller being driven, the bottom roller 58 can move downwardly when the partially embedded nail plates pass between the rollers. It has been found that by use of the floating bottom roller 58, the nail plates pass freely between the rollers without being bent or knocked off of the truss joints. However, the spring 102 provides a sufficient upward force on the bottom roller 58 to thereby allow the truss to nevertheless be gripped and pulled through the in-feed correction roller assembly 70.

The top in-feed correction roller 56 is mounted in a similar manner as the bottom roller 58, except that no spring is employed. Again, a conventional take-up bearing 140 is utilized to provide a rotational mount to the shaft 92 of the top in-feed correction roller 56. A pair of side channels of the take-up bearing 140 cooperate with corresponding rails 98 and 100 welded to the inside surfaces of the framed uprights 76 and 78. Welded to the top of each upright frame member 76 and 78 is a plate 142 with a threaded bore. This is shown in FIG. 6. The upper take-up bearing 140 is suspended from an anchor plate 144, where a pair of bolts 146 are utilized to fasten the anchor plate 144 to the threaded plates 142. Further, the anchor plate 144 includes a central threaded bore 148 through which a threaded bolt 150 engages. A lock nut 152 is utilized to fix the threaded bolt 150 with respect to the anchor plate 144. The end of the threaded bolt 150 freely passes through the top of the take-up bearing 140 and is captured by the use of a round collar 154. Much like the bottom take-up bearing 92 of the bottom in-feed correction roller 58, the round collar 154 is inserted into a receptacle 156 of the upper take-up bearing 140. A split pin 158 is driven through a bore in the collar 154 as well as a bore in the end of the threaded bolt 150, thereby allowing the threaded rod to rotate during adjustment with respect to the take-up bearing 140. The rotation of the threaded rod 150 in the threaded bore 148 of the anchor plate 144 allows the take-up bearing 140, and thus the roller 56, to be adjusted up or down to a desired position. With this arrangement, the upper in-feed correction roller 56 is adjustable in a vertical direction to a desired location, but does not float, as does the bottom in-feed correction roller 58. While the foregoing describes the upper and lower in-feed correction rollers as being respectively fixed and floating, those skilled in the art may prefer to drive the lower in-feed correction roller at a fixed vertical position, and let the upper in-feed correction roller 56 float by way of a similar bearing and spring arrangement.

Figure 9:
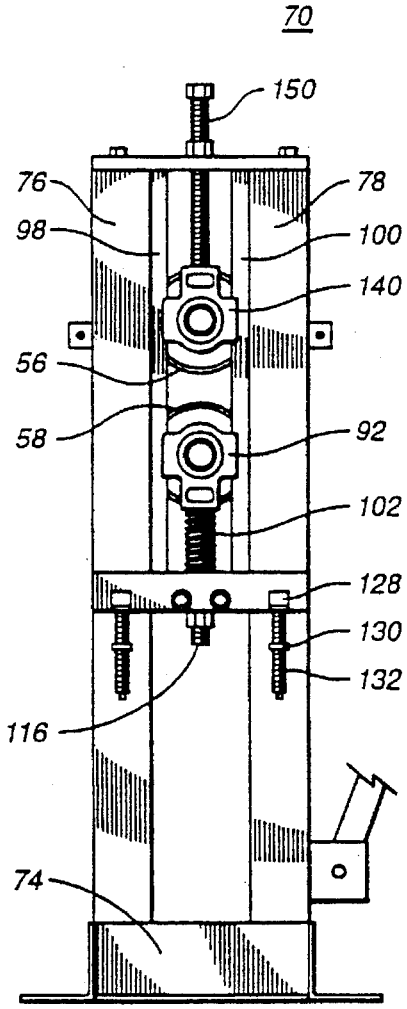
FIG. 9 is an end view of the in-feed correction roller assembly, showing the safety bar and having the safety panels removed therefrom.

FIG. 9 illustrates an end view of the in-feed correction roller assembly 70, as shown in exploded view in FIG. 6.

Figure 10:
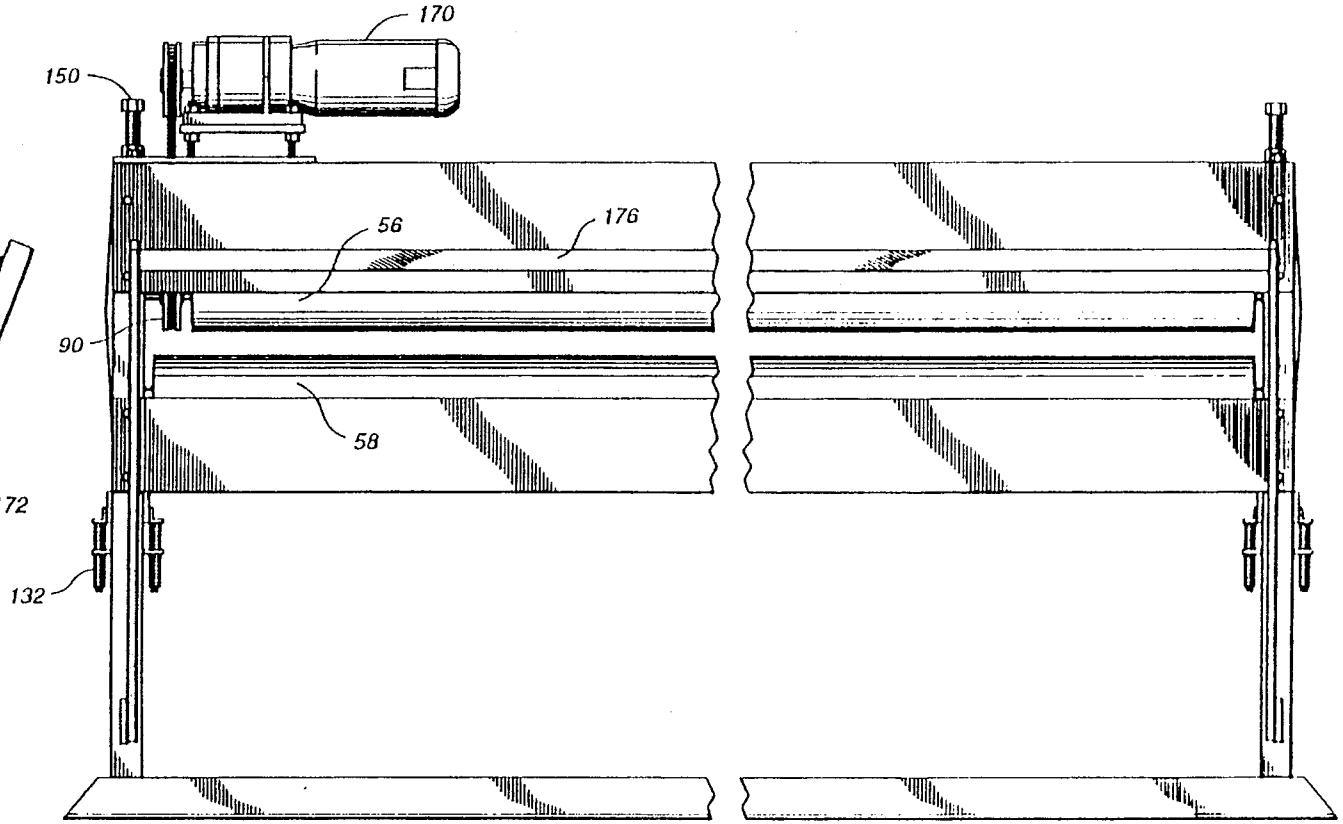
FIG. 10 is a frontal view of the in-feed correction roller assembly with the various safety panels attached thereto.
Figure 11:
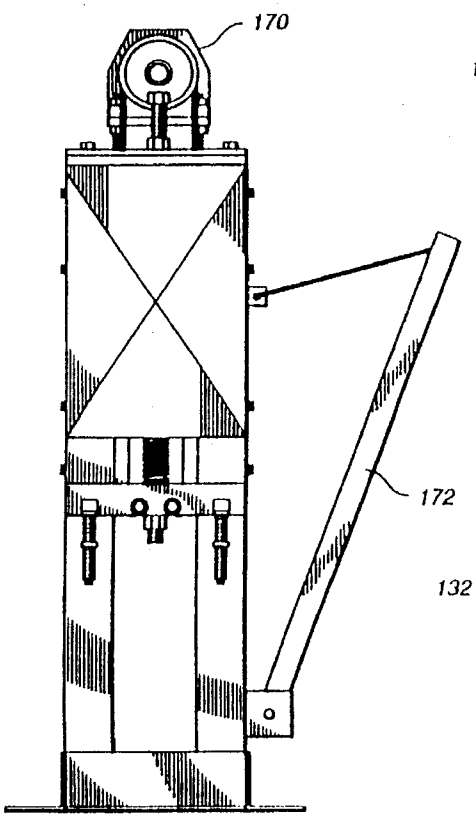
FIG. 11 is an end view of the in-feed correction roller assembly of FIG. 10.

FIGS. 10 and 11 show the in-feed correction roller assembly 70 in completed form, with the various protective covers shown, as well as a motor 170 mounted for driving the top in-feed correction roller 56. Additionally, a safety trip bar 172 is shown pivotally connected to the frontal side of the assembly 70. The safety trip bar 172 includes a horizontal tubular member 176 that extends along the entire length of the assembly 70. While not shown, when the safety trip bar 174 is pushed toward the machine, a switch is operated to remove the power from the motor 170 and stop rotation of the rollers 56 and 58.

As noted above, the in-feed correction roller assembly 70 is located in the assembly line, prior to the finish rollers 50 and 52 noted in FIG. 4. The in-feed correction roller assembly 70 is preferably a stand-alone frame mounted assembly which can be installed in existing truss assembly lines utilizing finish rollers. Finish rollers are conventional equipment utilized for completing the trusses by embedding the nail plates all of the way into the wood truss members. A conventional finish roller of the type adapted for use with the present invention is the 20" Roller Press obtainable from Alpine Engineered Products, Grand Prairie, Texas. Such type of finish rollers are also stand-alone equipment, fastened to the floor for receiving the incomplete trusses from driven roller conveyors, or the like.

Figure 13:
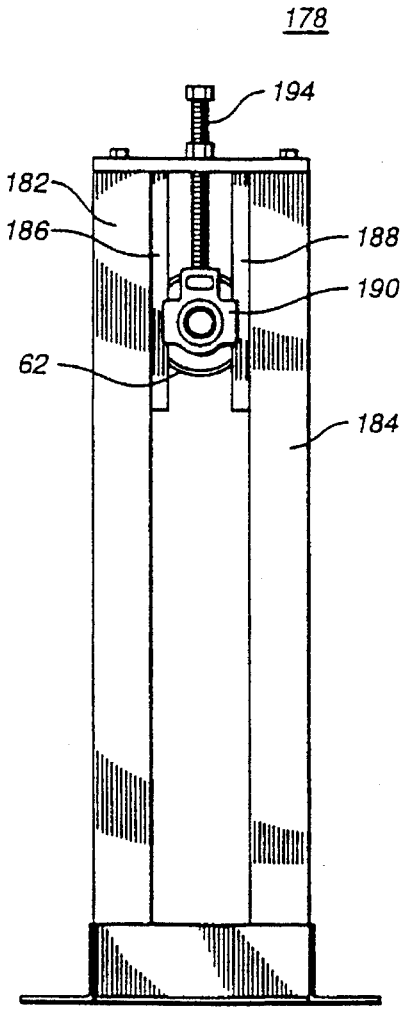
FIG. 13 is an end view of the out-feed correction roller assembly of FIG. 12.
Figure 12:
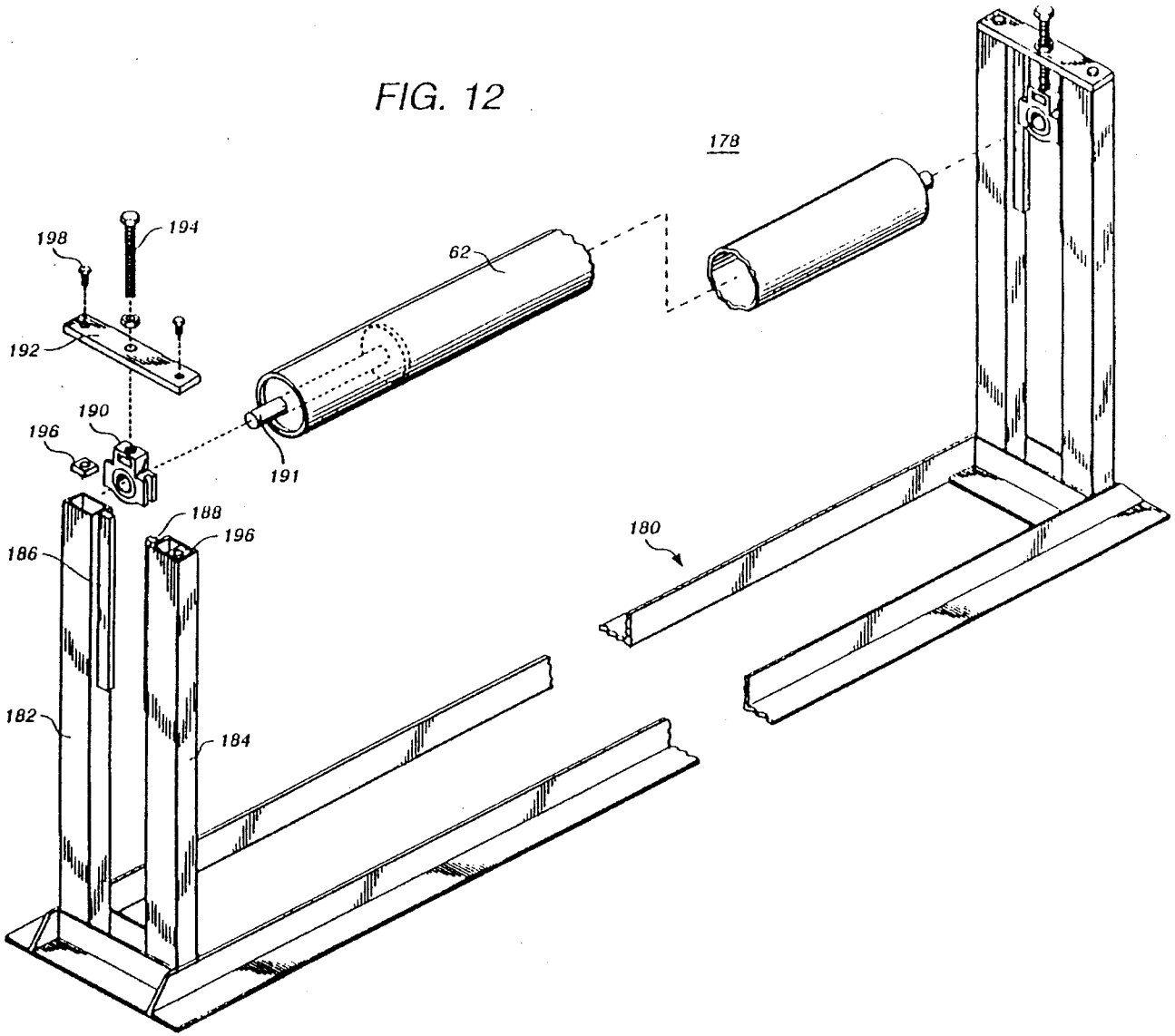
FIG. 12 is an isometric view of the out-feed correction roller with the various parts thereof shown removed from each other for purposes of clarity.

FIGS. 12 and 13 show respective isometric and end views of the out-feed correction roller assembly 178. Again, the roller 62 is mounted for rotation on a frame 180 that can be fastened to the floor of an assembly line. A pair of upright frame members 182 and 184 are fastened to the frame work 180 in a manner similar to the in-feed correction roller assembly of FIG. 6. Welded to the inside surfaces of the upright frame members 182 and 184 are respective rails 186 and 188 for providing a vertical sliding arrangement with respect to a take-up bearing 190. The shaft 191 of the out-feed correction roller 62 is adapted for rotation within the bore of the take-up bearing 190. The take-up bearing 190 is suspended by way of a anchor bracket 192 and threaded rod 194, in a manner substantially identical to that described in connection with the upper in-feed correction roller 56 of FIG. 6. A pair of threaded plates 196 are welded to the top of the rectangular tubular upright frame members 182 and 184. A pair of bolts 198 are employed to fastened the anchor bracket 192 to the respective threaded brackets 196. The opposite end of the out-feed correction roller 62 is mounted for rotation and vertical adjustment in the same manner. With this arrangement, the out-feed correction roller 62 can be adjusted vertically with respect to the finish rollers and thereby provide the desired degree of counterbend. An end view of the out-feed correction roller assembly 178 is shown in FIG. 13, without any protective cover plates.

Both the in-feed correction rollers 56 and 58, as well as the out-feed correction roller 62, are laterally spaced from the vertical axis of the finish rollers by about 18–24 inches. With the rollers of the truss bend correction system being sufficiently close, the metal nail plates are reformed to remove the undesired camber therein, without the wooded truss members being flexed or bent to any significant degree.

While the preferred embodiment of the invention utilizes individual frame components for the in-feed correction roller assembly 70, the finish roller assembly and the out-feed correction roller assembly 178, such feature is not necessary to the realization of the advantages of the invention. By utilizing separate frames for the assemblies, the correction roller assemblies can be integrated into an existing truss assembly line employing conventional finish rollers. In this manner, the cost of new finish rollers is not required, but rather the possible repositioning thereof may be needed to utilize the correction roller assemblies as described above.

Figure 14:
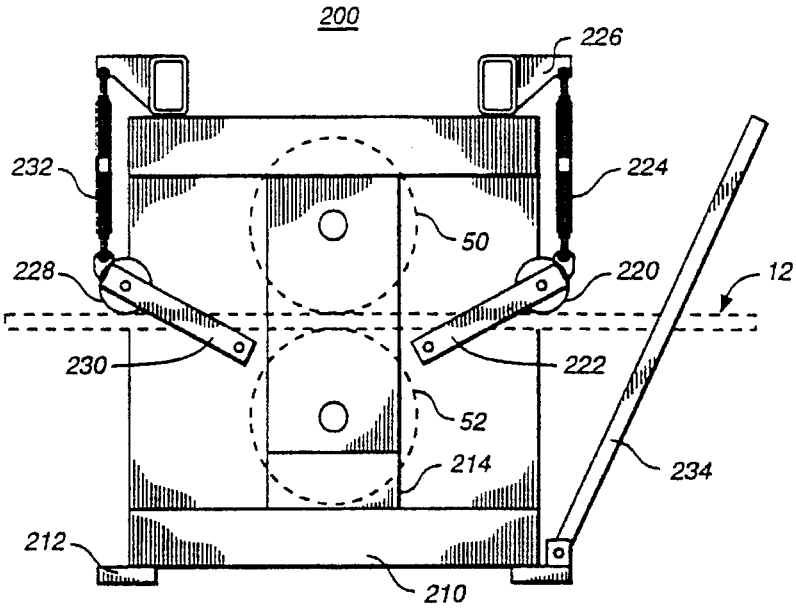
FIG. 14 is an end view of another embodiment of the invention, showing the finish rollers and the in-feed and out-feed correction rollers assembled as a unitary system.

However, in new truss assembly lines, or where finish rollers are not presently employed, the unitary frame assembly shown in FIG. 14 can be employed. Here, the truss bend correction system 200 includes a single frame 210 supported on pads or feet 212 for fastening to the floor. A pair of finish rollers 50 and 52 are mounted to the frame 210 by way of opposing vertical uprights 214. The spacing between the finish rollers 50 and 52 for slightly compressing the wood members of the truss 12 can be adjusted in a conventional manner using shims or spacers.

An in-feed correction roller 220 is fixed at each end thereof by a pivotal arm 222. The pivoting end of the arm 222 is connected to a turn buckle 224 for providing adjustment thereof. The upper end of the turn buckle 224 is fixed to a frame member 226 which, in turn, is fastened to the general frame work 210 of the system. Adjustment of the turnbuckle 224 to extend the length thereof, effectively lowers the in-feed correction roller 220 for allowing a greater degree of counterbending. The in-feed roller 220 is not driven, but rather is operable only to apply a downward pressure on trusses passed through the system. As noted in the embodiment of FIG. 14, no bottom in-feed correction roller is shown, but one could be utilized and adjusted by the same or a different turnbuckle. The out-feed correction roller 228 is also mounted to a pivotal arm 230 and is adjusted by way of a turnbuckle 232. Again, the turnbuckle 232 is adjusted to vary the effective height of the out-feed correction roller 228 to thereby impart a desired counterbend to the joints of a truss 12. For purposes of safety, a hingable safety bar 234 is located at the in-feed end of the truss bend correction system 200. The safety bar 234 is responsive to inward movement to actuate a switch to remove power from the motor that rotates the top finish roller 50.

As can be seen from the foregoing, a truss bend correction system has been disclosed for efficiently removing the undesired camber formed in the metal nail plates of truss joints. The system can be effectively installed in existing truss fabricating assemblies. The dynamic operation of the system does not require any significant fabricating time, and constitute a relatively uncomplicated and reliable mechanism.

While the preferred and other embodiments of the methods and apparatus have been disclosed with reference to specific structures, techniques and the like, it is to be understood that many changes in detail may be made as a matter of engineering choices, without departing from the spirit and scope of the invention as defined by the appended claims. Indeed, those skilled in the art may prefer to embody the apparatus in other forms, and in light of the present description, they will find it easy to implement that choice. Also, it is not necessary to adopt all of the various advantages and features of the present disclosure into a single composite assembly in order to realize the individual advantages disclosed herein.

What is claimed is:

1. A truss bend correction system of the type adapted for counterbending truss joints fastened together with nail plates, comprising:

a first plurality of rollers arranged in a finish path through which the truss passes to press the nail plates into the truss joints, said first plurality of rollers aligned along a common axis generally orthogonal to the finish path, said rollers having an in-feed side and an out-feed side; and means cooperating with said first plurality of rollers for imparting a counterbend to a bow formed in the truss joint as a result of a prior joint fastening operation.

2. The truss bend correction system of claim 1, wherein at least one of said rollers is driven to continuously move the truss through the system.

3. The truss bend correction system of claim 1, wherein said means for imparting a counterbend comprises an in-feed roller assembly having a pair of spaced apart rollers through which the truss passes, said in-feed roller assembly positioned on said in-feed side of said first plurality of rollers.

4. The truss bend correction system of claim 3, wherein said rollers are arranged to define a circuitous counterbending path.

5. The truss bend correction system of claim 3, wherein said means for imparting a counterbend further comprises an out-feed correction roller positioned on the out-feed side of said first plurality of rollers.

6. A truss bend system correction system of the type adapted for counterbending truss joints fastened together with nail plates, comprising:

a pair of spaced-apart cylindrical finish rollers for applying a compressive force to the joints of the truss, said finish rollers aligned along a common axis generally orthogonal to a finish path through which the truss passes, said finish rollers having an in-feed side and an out-feed side;

at least one in-feed correction roller located on said in-feed side of the finish rollers;

at least one out-feed correction roller located on said out-feed side of the finish rollers; and said in-feed correction roller and said out-feed correction roller being oriented vertically with respect to the spacing between the finish rollers to impart a counterbend to the truss joints as the truss is passed through the truss bend correction system.

7. The truss bend correction system of claim 6, wherein said in-feed and out-feed correction rollers are each adjustable in a vertical direction.

8. The truss bend correction system of claim 6, wherein the in-feed correction roller, the finish rollers and the out-feed correction roller are fixed for rotation in a single unitary frame assembly.

9. A truss bend correction system of the type for counterbending wooden truss joints fastened together with nail plates, comprising:

an in-feed roller assembly including a pair of rollers vertically spaced apart from each other, at least one said in-feed roller being driven, and the other in-feed roller being spring tensioned so that the truss is pulled through the in-feed rollers but does not substantially embed the nail plates further into the wood truss members;

a finish roller assembly located downstream from the in-feed roller assembly, said finish roller assembly including a pair of vertically spaced apart finish rollers for embedding the nail plates into respective joints of the truss, one said finish roller being driven to pull the truss through the system;

an out-feed correction roller assembly having at least one roller located downstream from the finish roller assembly; and said in-feed, finish and out-feed roller assemblies defining a truss path for counterbending the joints of the truss.

10. The truss bend correction system of claim 9, wherein each said assembly is mounted to a single unitary frame support.

11. The truss ben correction system of claim 9, wherein each roller of said in-feed and out-feed correction assemblies includes an axle, and further including a bearing for each axle and a channel and rail arrangement between a respective frame member and the bearings for adjustably fixing the rollers at a desired height.

12. A method of counterbending truss joints fastened together with a nail plate, comprising the steps of:

arranging a plurality of elongate rollers in a path through which the truss passes to bend the truss joints in a direction opposite a bow formed therein as a result of a prior joint fastening operation.

13. The method of claim 12, further including moving the truss in a continuous movement through the truss bend correction system.

14. The method of claim 12, further including embedding the nail plates completely into the wood members of the truss as the truss passes through the truss bend correction system.

15. A truss bend system correction system of the type adapted for counterbending truss joints fastened together with nail plates, comprising:

a pair of spaced-apart finish rollers for applying a compressive force to the joints of the truss;

a pair of spaced apart, in-feed correction rollers between which the truss passes, said in-feed correction rollers located on an in-feed side of the finish rollers;

at least one out-feed correction roller located on an out-feed side of the finish rollers; and said in-feed correction rollers and said out-feed correction roller being oriented vertically with respect to the spacing between the finish rollers to impart a counterbend to the truss joints as the truss is passed through the truss bend correction system.

16. The truss bend system correction system of claim 15, wherein one said in-feed correction rollers is motor driven.

17. The truss bend correction system of claim 16, wherein the other said in-feed correction roller is rotatably mounted and spring tensioned toward said one in-feed correction roller.

18. A truss bend system correction system of the type adapted for counterbending truss joints fastened together with nail plates, comprising:

a pair of spaced-apart finish rollers for applying a compressive force to the joints of the truss, said finish rollers having an in-feed side and an out-feed side;

at least one in-feed correction roller located on said in-feed side;

at least one out-feed correction roller located on said out-feed side of the finish rollers;

said in-feed correction roller and said out-feed correction roller being oriented vertically with respect to the spacing between the finish rollers to impart a counterbend to the truss joints as the truss is passed through the truss bend correction system;

wherein said in-feed and out-feed correction rollers are each adjustable in the vertical direction;

wherein each axle of said in-feed and out-feed correction rollers is rotatably mounted to a bearing; and a frame structure supporting the respective in-feed and out-feed correction rollers, said frame having a channel-and-rail arrangement for allowing vertical adjustment of the bearing within said frame structure.

19. A truss bend system correction system of the type adapted for counterbending truss joints fastened together with nail plates, comprising:

a pair of spaced-apart finish rollers for applying a compressive force to the joints of the truss, said finish rollers having an in-feed side and an out-feed side;

at least one in-feed correction roller located on said in-feed side;

at least one out-feed correction roller located on said out-feed side of the finish rollers;

said in-feed correction roller and said out-feed correction roller being oriented vertically with respect to the spacing between the finish rollers to impart a counterbend to the truss joints as the truss is passed through the truss bend correction system; and wherein said in-feed correction roller, said finish rollers, and said out-feed correction roller each comprise an independent assembly with a respective support frame.

20. A truss bend system correction system of the type adapted for counterbending truss joints fastened together with nail plates, comprising:

a pair of spaced-apart finish rollers for applying a compressive force to the joints of the truss;

at least one in-feed correction roller located on said in-feed side of the finish rollers;

at least one out-feed correction roller located on an out-feed side of the finish rollers;

said in-feed correction roller and said out-feed correction roller being oriented vertically with respect to the spacing between the finish rollers to impart a counterbend to the truss joints as the truss is passed through the truss bend correction system; and a driven roller conveyor for transporting incomplete truss assemblies to said in-feed correction roller.

21. A truss bend system correction system of the type adapted for counterbending truss joints fastened together with nail plates, comprising:

a pair of spaced-apart finish rollers for applying a compressive force to the joints of the truss, said finish rollers aligned along a common axis generally orthogonal to the finish path of the truss, said finish rollers having an in-feed side and an out-feed side; and a pair of spaced apart in-feed correction rollers between which the truss passes, said in-feed correction rollers positioned on said in-feed side of said finish rollers and positioned to impart a counterbend to the truss joint of the truss as the truss is passed through the truss bend correction system.

22. A truss bend system correction system of claim 21, further comprising at least one out-feed correction roller positioned on said out-feed side of said finish rollers.

23. A truss bend correction system comprising:

a plurality of cylindrical rollers having a sufficient length for supporting a truss, said rollers arranged to define a counterbending path for the truss to bend the truss joints in a direction opposite a bow formed therein as a result of a prior joint fastening operation;

at least one of said plurality of rollers comprising an in-feed correction roller having a lower surface;

at least one of said plurality of rollers comprising an out-feed correction roller spaced part from said in-feed correction roller, said out-feed correction roller having a lower surface aligned along a first common axis with the lower surface of said in-feed correction roller; and at least one of said plurality of rollers comprising a center roller disposed between said in-feed correction roller and said out-feed correction roller, said center roller having an axis of rotation spaced apart from said first common axis.

24. A truss bend system correction system of claim 23, wherein said center roller comprises a pair of spaced apart finish rollers, said finish rollers aligned along a second common axis generally orthogonal to said first common axis.

25. A truss bend system correction system of claim 24, wherein said in-feed correction roller comprises a pair of in-feed correction rollers between which the truss passes, said in-feed correction rollers positioned on an in-feed side of said finish rollers to impart a counterbend to the truss joint of the truss as the truss is passed through the truss bend correction system.

* * * * *

UNITED STATES PATENT AND TRADEMARK OFFICE

CERTIFICATE OF CORRECTION

PATENT NO. : 5,582,099
DATED : December 10, 1996
INVENTOR(S) : Michael C. Rosser It is certified that error appears in the above-indentified patent and that said Letters Patent is hereby corrected as shown below:

In Column 11, line 53 change "ben" to -- bend--;

In Column 14, line 4 change "truss" (2nd Occurrence) to --truss'-- and

In Column 14, line 11 change "part" to -- apart--.

Signed and Sealed this

First Day of April, 1997

*Attest:*

*Attesting Officer*

BRUCE LEHMAN

*Commissioner of Patents and Trademarks*